US008770105B2

(12) United States Patent
Moon et al.

(10) Patent No.: US 8,770,105 B2
(45) Date of Patent: Jul. 8, 2014

(54) PRINTING APPARATUS AND METHOD FOR FORMING THIN FILM PATTERN USING THE PRINTING APPARATUS

(75) Inventors: Tae-Hyoung Moon, Gwangmyeong-si (KR); Seung-Hee Nam, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 491 days.

(21) Appl. No.: 12/832,145

(22) Filed: Jul. 8, 2010

(65) Prior Publication Data

US 2011/0005415 A1 Jan. 13, 2011

(30) Foreign Application Priority Data

Jul. 9, 2009 (KR) ..... 10-2009-0062460

(51) Int. Cl.
*B41F 3/36* (2006.01)
*B41F 7/02* (2006.01)

(52) U.S. Cl.
USPC ..... 101/158; 101/163; 101/170; 101/492

(58) Field of Classification Search
USPC ..... 101/158, 170, 483, 163, 492
See application file for complete search history.

(56) References Cited

U.S. PATENT DOCUMENTS 3,483,027 A * 12/1969 Mache et al. ..... 216/52
5,992,320 A * 11/1999 Kosaka et al. ..... 101/401.1
2008/0223240 A1* 9/2008 Drury et al. ..... 101/492

FOREIGN PATENT DOCUMENTS

JP 43028429 A * 12/1943
JP 2000-255025 9/2000
JP 2005353770 A * 12/2005
JP 2007-268853 10/2007
JP 2007-273712 A 10/2007
JP 2007268853 A * 10/2007

OTHER PUBLICATIONS

Machine English Translation of JP 2007-273712. Oct. 2007.*

* cited by examiner

*Primary Examiner* — Ren Yan
(74) *Attorney, Agent, or Firm* — McKenna Long & Aldridge LLP

(57) ABSTRACT

The present invention relates to a printing apparatus and method for forming a thin film pattern using the printing apparatus which can form a multi-layered thin film pattern on a substrate.

15 Claims, 16 Drawing Sheets

PRINTING APPARATUS AND METHOD FOR FORMING THIN FILM PATTERN USING THE PRINTING APPARATUS

CROSS REFERENCE TO RELATED APPLICATION

This application claims the benefit of the Patent Korean Application No. 10-2009-0062460, filed on Jul. 9, 2009, which is hereby incorporated by reference as if fully set forth herein.

BACKGROUND OF THE DISCLOSURE

1. Field of the Disclosure

The present invention relates to a printing apparatus and method for forming a thin film pattern using the printing apparatus which can form a multi-layered thin film pattern on a substrate.

2. Discussion of the Related Art

Recently, various kinds of flat display devices have been developed, which can reduce weight and volume that are disadvantages of a cathode ray tube. As the flat display device, there are a liquid crystal display device, a field emission display device, a plasma display panel, an electroluminescence EL display device, and so on.

The flat display device is provided with a plurality of thin films formed by mask process including a deposition step, an exposure step, a development step, and etching step, and so on. However, since the mask process as a complicate fabrication process, the mask process increases a production cost. Consequently, researches for forming the thin film by using a printing process utilizing a blanket roller are under progress.

The printing process is a process in which printing ink is coated on a blanket of a blanket roller, a pattern of the printing ink is formed on the blanket roller by using a printing plate, and the pattern of the printing ink is transcribed to a substrate, thereby forming a desired thin film.

In this instance, if a metal film of silver Ag is formed by using ink having silver Ag powder dispersed therein, there has been a problem in that the metal film of silver is separated from the substrate due to low adhesive force between silicon contained in the substrate and the silver.

In order to solve the problem, if the metal film is formed of printing ink having a metal which has good adhesive force to the substrate and the silver powder added thereto, dispersion stability of the ink is broken easily due to reaction among dispersion binders which are different for every metal.

SUMMARY OF THE DISCLOSURE

Accordingly, the present invention is directed to a printing apparatus.

An object of the present invention is to provide a printing apparatus and method for forming a thin film pattern using the printing apparatus which can form a multi-layered thin film pattern on a substrate.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a printing apparatus includes a blanket roller, a first outlet for discharging first printing ink to the blanket roller, and a second outlet for discharging second printing ink to the blanket roller having the first printing ink coated thereon in a state viscosity of the first printing ink is higher than a time when the first printing ink is discharged to the blanket roller, wherein the first and second outlets are formed in the same printing nozzle or different printing nozzles.

The printing apparatus further includes a printing plate for removing the first and second printing ink from the blanket roller partially to form a conductive thin film on the blanket roller, and a substrate for having the conductive thin film transcribed thereto from the blanket roller.

The first outlet is formed in the first printing nozzle and the second outlet is formed in the second printing nozzle, and the substrate and the printing plate are positioned between the first and second printing nozzles.

The first outlet is formed in the first printing nozzle and the second outlet is formed in the second printing nozzle, and the first and second printing nozzles are formed adjacent to the printing plate, and the first and second outlets are formed perpendicular to each other.

The first and second outlets are formed in the same nozzle, and the first and second outlets have line widths different from each other.

The first printing ink consists of metal nano-powder including silver, and a solvent of a low boiling point, and a solvent of a high boiling point, and the solvent of a low boiling point vaporizes before the second printing ink is coated such that viscosity of the first printing ink becomes higher than an initial state when the first printing ink is discharged from the first outlet.

The second printing ink includes $SnO_2$ which is a substance having adhesive force to the substrate better than the first printing ink.

In another aspect of the present invention, a printing apparatus includes a blanket roller, a first outlet for discharging first printing ink to the blanket roller, the first printing ink consists of metal nano-powder, a solvent of a low boiling point and a solvent of a high boiling point, and a second outlet for discharging second printing ink to the blanket roller having the first printing ink coated thereon in a state viscosity of the first printing ink is higher than a time when the first printing ink is discharged to the blanket roller, wherein the first and second outlets are formed in the same printing nozzle or different printing nozzles.

The solvent of a low boiling point vaporizes before the second first printing ink is coated such that viscosity of the first printing ink becomes higher than an initial state when the first printing ink is discharged from the first outlet.

The second printing ink includes $SnO_2$ which is a substance having adhesive force to the substrate better than the first printing ink.

To achieve these objects and other advantages and in accordance with the purpose of the invention, as embodied and broadly described herein, a method for forming a thin film pattern includes providing a printing apparatus having a blanket roller, a first outlet and a second outlet; discharging first printing ink to the blanket roller using the first outlet; and discharging second printing ink to the blanket roller having the first printing ink coated thereon using the second outlet in a state viscosity of the first printing ink is higher than a time when the first printing ink is discharged to the blanket roller, wherein the first and second outlets are formed in the same printing nozzle or different printing nozzles.

The method for forming the thin film pattern further includes forming a conductive thin film on the blanket roller by rolling the blanket roller having the first and second printing ink on a printing plate; and transcribing the conductive thin film by rolling the blanket roller on a substrate.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DESCRIPTION OF SPECIFIC EMBODIMENTS

Reference will now be made in detail to the specific embodiments of the present invention, examples of which are illustrated in the accompanying drawings. Wherever possible, the same reference numbers will be used throughout the drawings to refer to the same or like parts.

Figure 1:
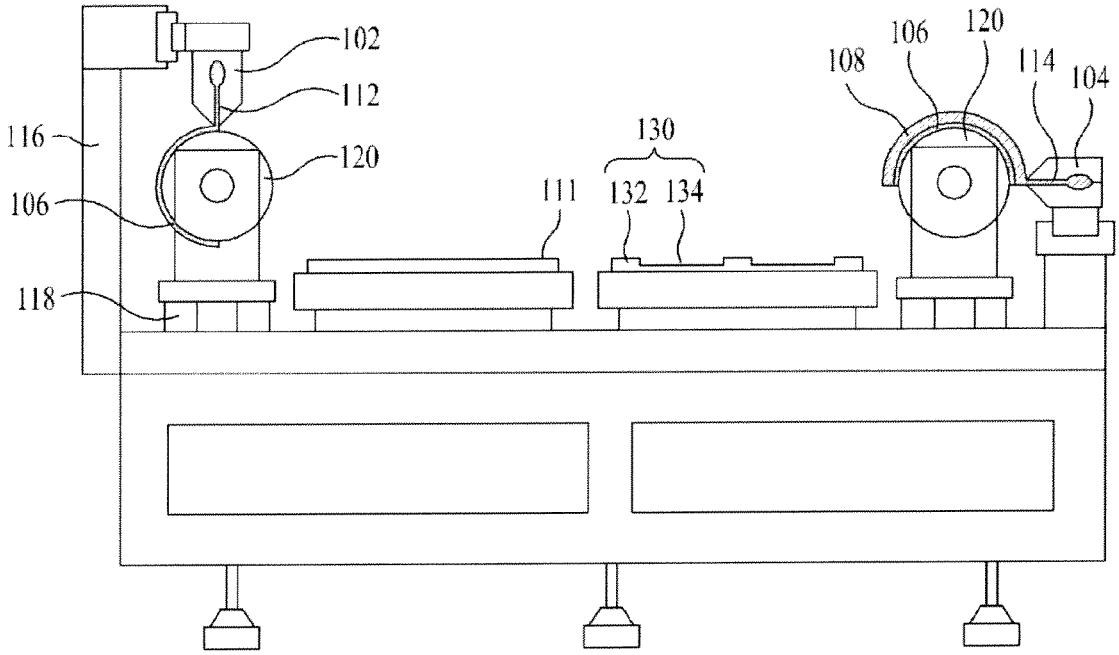
FIG. 1 illustrates a section of a printing apparatus in accordance with a first embodiment of the present invention.

FIG. 1 illustrates a section of a printing apparatus in accordance with a first embodiment of the present invention.

Referring to FIG. 1, the printing apparatus has a reverse off-set roll printing applied thereto and includes first and second printing nozzles 102 and 104, blanket rollers 120, a printing plate 130, roller aligning units 118, and nozzle aligning units 116.

The first printing nozzle 102 is adjacent to a substrate 111, and has a first outlet 112 formed parallel with a thickness direction or a length direction of the substrate 111. The first printing nozzle 102 holds first printing ink 106 for supplying to the blanket roller 120 through the first outlet 112.

The first printing ink 106 consists of first metal nano-powder of a metal having high conductivity, a solvent of a low boiling point, and a solvent of a high boiling point.

The first metal nano-powder is formed of at least a metal selected from silver Ag, gold Au, chromium Cr, and nickel Ni, and preferably silver Ag having high conductivity and favorable in view of price. Since the first metal nano-powder is particles, with an excellent atypical characteristic, the first metal nano-powder has excellent pattern formability.

The solvent of a low boiling point enables to spray the first metal nano-powder in an independent state. Since the solvent of a low boiling point vaporizes before a second printing ink 108 is coated after the first printing ink 106 is coated, viscosity of the first printing ink 106 becomes higher than an initial state when the first printing ink 106 is discharged from the first outlet 112.

The solvent of a high boiling point serves the first metal nano-powder coated on the blanket roller 120 to maintain the independent state from one another and have high viscosity when the solvent of a low boiling point vaporizes by heat.

The second printing nozzle 104 is adjacent to the printing plate 130 spaced from the first printing nozzle 102. In detail, between the first and second printing nozzles 102 and 104, there are the substrate 111 and the printing plate 130.

In this instance, the second printing nozzle 104 is spaced a distance away from the first printing nozzle 102 such that the solvent of a low boiling point on the blanket roller 120 secures an enough vaporizing time period during the blanket roller 120 moves. A second outlet 114 of the second printing nozzle 104 is formed parallel to a length direction or a thickness direction of the substrate 111 such that the second outlet 114 is perpendicular or parallel to the first outlet 112 of the first printing nozzle 102.

The second printing nozzle 104 holds second printing ink 108 for supplying to the blanket roller 120 through the second outlet 114.

In order to make the second printing ink 108 to form a layer thicker than the first printing ink 106, the second outlet 114 of the second printing nozzle 104 has a line width greater than the same of the first outlet 112 of the first printing nozzle 102, or the second printing ink 108 is applied a plurality of times.

The second printing ink 108 consists of second metal nano-powder different from the first metal nano-powder, and a solvent.

The second metal nano-powder is second metal such as $SnO_2$ having a melting point higher than the first metal nano-powder to have adhesive force to the substrate better than the first metal. The second metal prevents the vaporization from taking place at the time of high temperature treatment, to enhance thermal stability of the conductive thin film pattern and improve adhesive force of the conductive thin film pattern to the substrate 111 at the time of the high temperature treatment.

The blanket roller 120 rolls on the printing plate 130 and the substrate 111 in succession, making contact therewith.

The printing plate 130 is brought into contact with the blanket roller 120 such that the first and second printing ink 106 and 108 coated on the blanket roller 120 is applied to desired areas. To do this, the printing plate 130 includes a depressed pattern 134 and a relieved pattern 132. When the blanket roller 120 rolls on the printing plate 130, the relieved pattern 132 is brought into contact with the first and second printing ink 106 and 108 coated on the blanket roller 120. According to this, when the blanket roller 120 rolls on the printing plate 130, the first and second printing ink 106 and 108 is transcribed from the blanket roller 120 to the relieved pattern 132. However, even if the blanket roller 120 rolls on the printing plate 130, the depressed pattern 134 is not brought into contact with the first and second printing ink 106 and 108 on the blanket roller 120. According to this, the first and second printing ink 106 and 108 on the blanket roller 120 matched to the depressed pattern 134 is remained on the blanket roller 120 to form the conductive metal pattern.

The roller aligning units 118 are connected to the blanket rollers 120 for adjusting positions of the blanket rollers 120 positioned on one sides of the first and second printing nozzles 102 and 104, respectively.

The nozzle aligning units 116 are connected to the first and second printing nozzles 102 and 104 respectively for adjusting positions of the first and second printing nozzles 102 and 104, respectively.

Thus, since the printing apparatus of the present invention can form at least two layers of printing ink on the blanket roller 120, enabling to form multi-layered thin films on the substrate 111 by one time of printing, a fabrication process can be made simple and a cost can be saved. Moreover, the application of the second printing ink 108 on the first printing ink 106 having the solvent of the low boiling point vaporized therefrom so as to be in a semi-dried state enhances adhesive force between the first and second printing ink 106 and 108. Furthermore, since the printing apparatus of the present invention forms the metal thin film pattern without a photolithography step, a cost can be saved.

Figure 2:
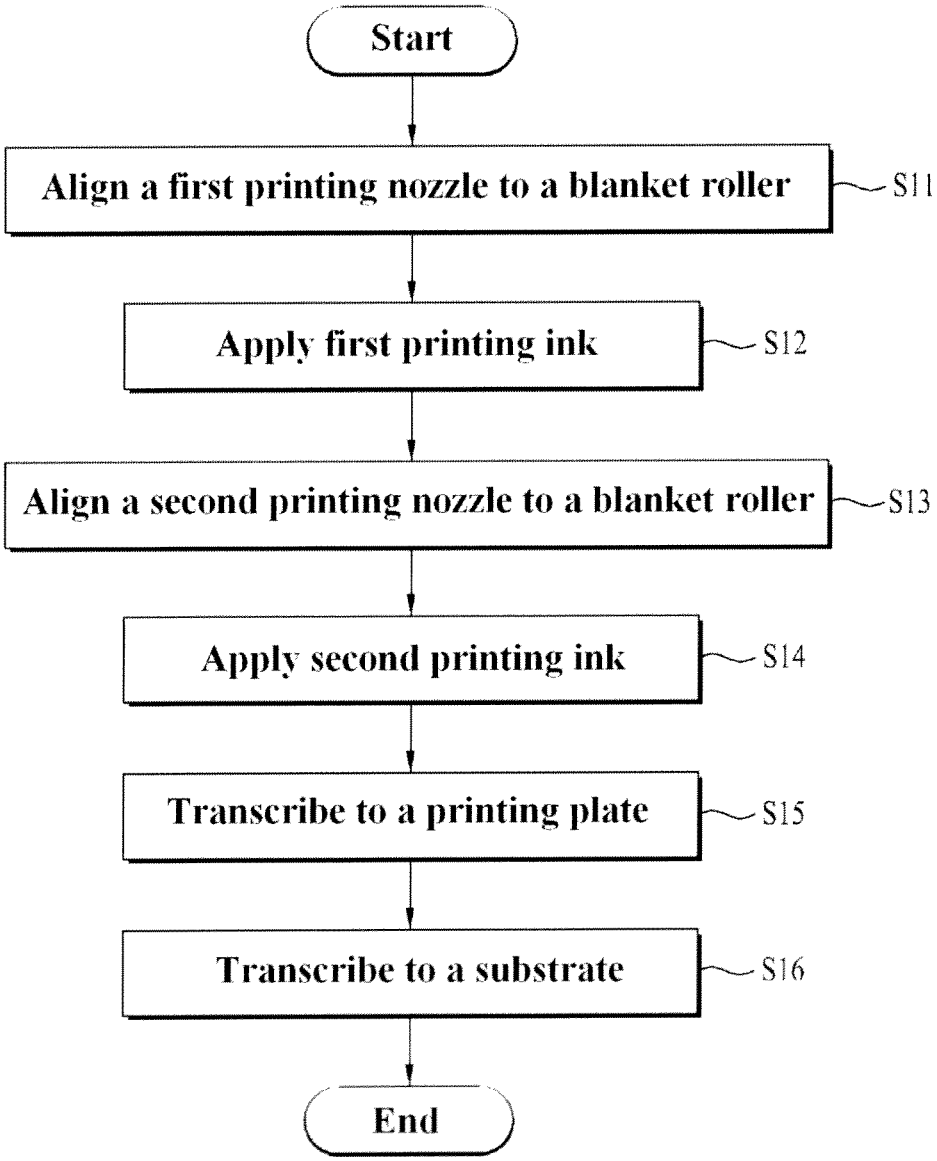
FIG. 2 illustrates a flow chart showing the steps of a method for forming a thin film pattern with a printing apparatus in accordance with a first embodiment of the present invention.

FIG. 2 illustrates a flow chart showing the steps of a method for forming a thin film pattern with a printing apparatus in FIG. 1, and FIGS. 3A~3F illustrate sections showing the steps of a method for forming a thin film pattern in FIG. 2.

Figure 3A:
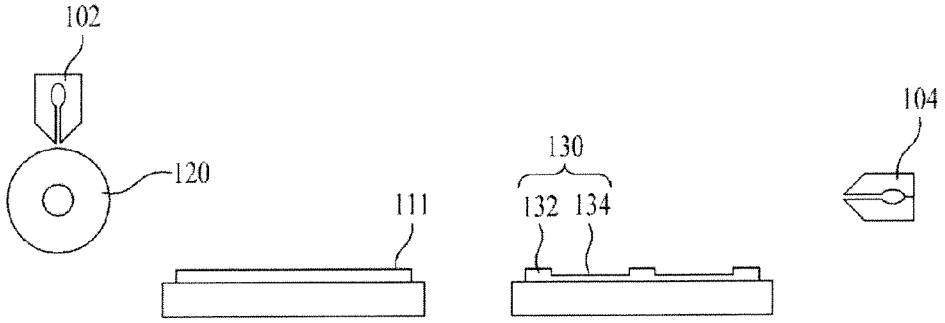
FIGS. 3A to 3F illustrate sections showing the steps of a method for forming a thin film pattern with a printing apparatus in accordance with a first embodiment of the present invention.

Referring to FIGS. 2 and 3A, as at least one of the blanket roller 120 and the first printing nozzle 102 moves through at least one of the roller aligning units 118 and the nozzle aligning units 116, positions of the blanket roller 120 and the first printing nozzle 102 are aligned (S11). In this instance, the blanket roller 120 is positioned adjacent to the first printing nozzle 102.

Figure 3B:
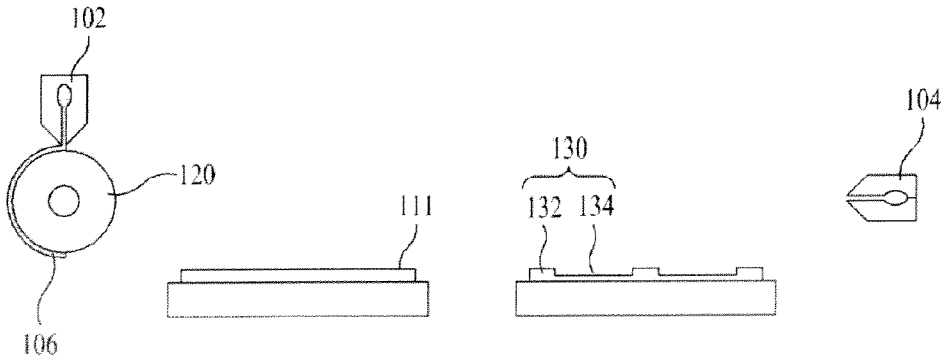

Referring to FIG. 3B, the first printing ink 106 is applied to the blanket roller 120 aligned with the first printing nozzle 102 thus, which is discharged through the first printing nozzle 102 (S12).

Figure 3C:
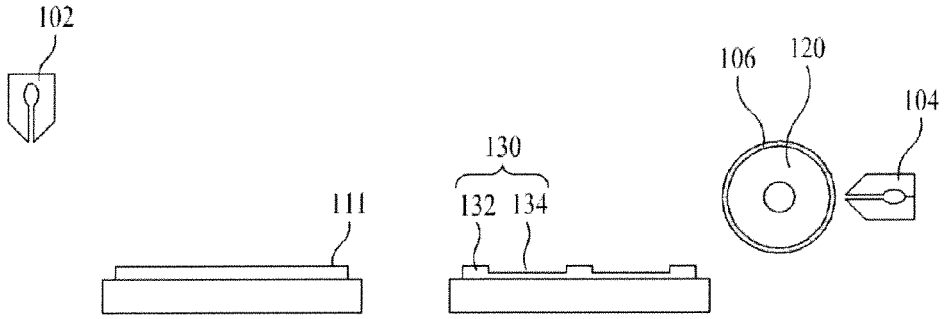

Referring to FIG. 3C, at least one of the blanket roller 120 having the first printing ink 106 applied thereto thus and the second printing nozzle 104 moves until the same is aligned with the second printing nozzle 104 (S13). In this instance, the blanket roller 120 is positioned adjacent to the second printing nozzle 104.

Figure 3D:
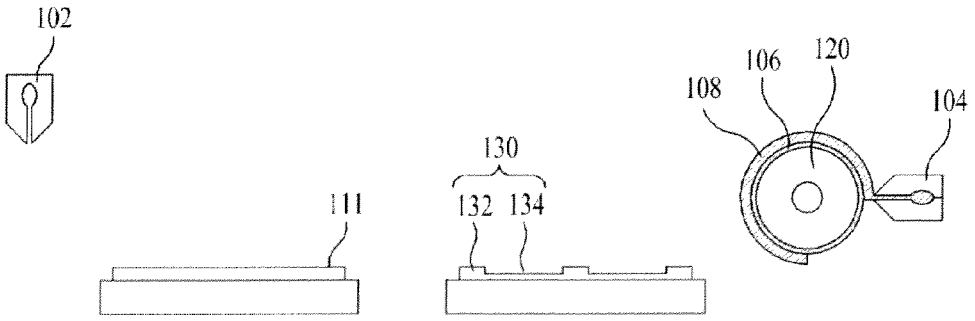

Referring to FIG. 3D, the second printing ink 108 is applied to the first printing ink 106 in a semi-dried state on the blanket roller 120 aligned with the second printing nozzle 104 thus through the second printing nozzle 104 (S14). In this instance, the second printing ink 108 is applied to the blanket roller 120 within approx. 5 minutes after the first printing ink 106 is applied thereto. Since the first printing ink 106 is dried fully, if the 5 minutes exceeds after the first printing ink 106 is applied thereto, adhesive force of the second printing ink 108 to the first printing ink 106 becomes poor.

Figure 3E:
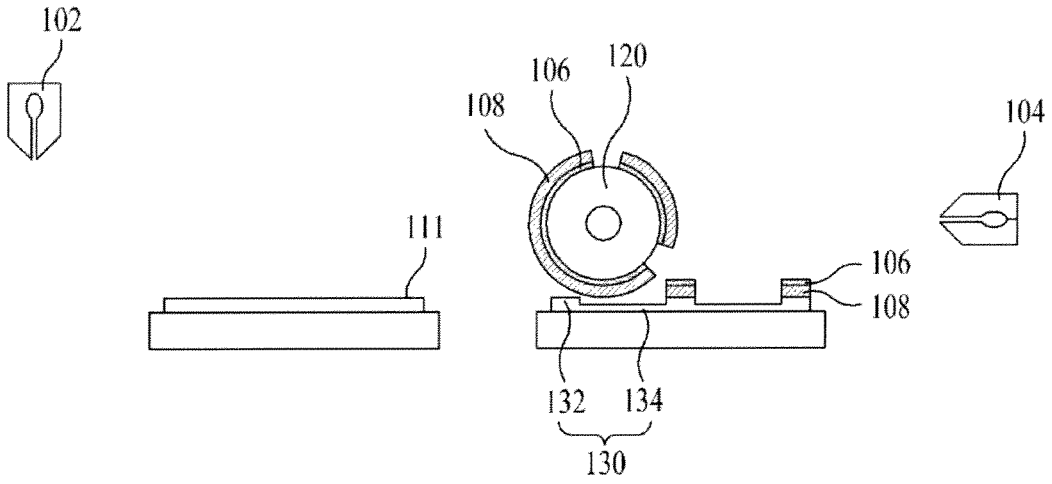

Referring to FIG. 3E, the blanket roller 120 having the first and second printing ink 106 and 108 applied thereto in succession thus rolls on the printing plate 130 having the depressed pattern 134 and the relieved pattern 132 (S15). The first and second printing ink 106 and 108 in areas which are brought into contact with the relieved pattern 132 has the first and second printing ink 106 and 108 transcribed thereto, and the first and second printing ink 106 and 108 in areas which are not brought into contact with the depressed pattern 134 is remained on a surface of the blanket roller 120.

Figure 3F:
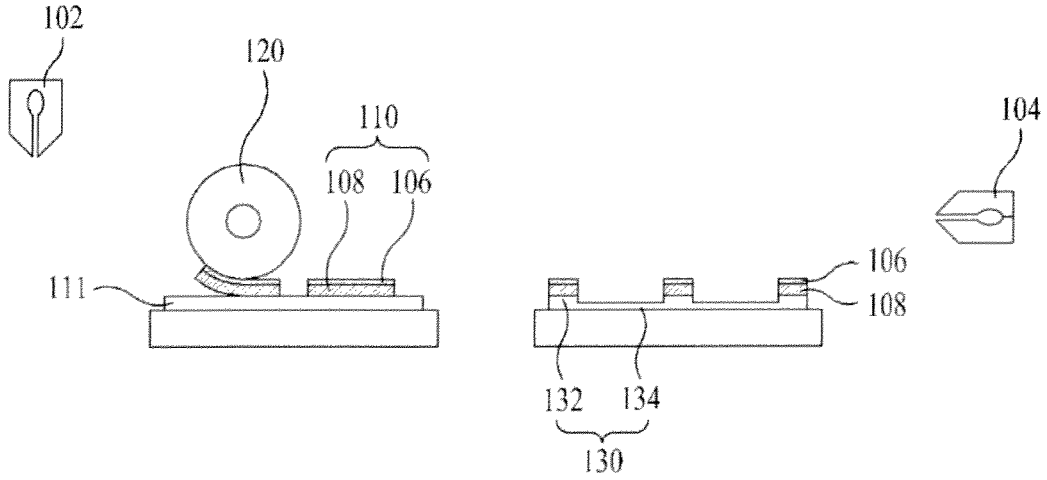

Referring to FIG. 3F, the blanket roller 120 having the first and second printing ink 106 and 108 remained thereon rolls on the substrate 111 (S16). According to this, the first and second printing ink 106 and 108 is transcribed, dried and cured on the substrate 111, to form the conductive metal pattern 110.

Figure 4:
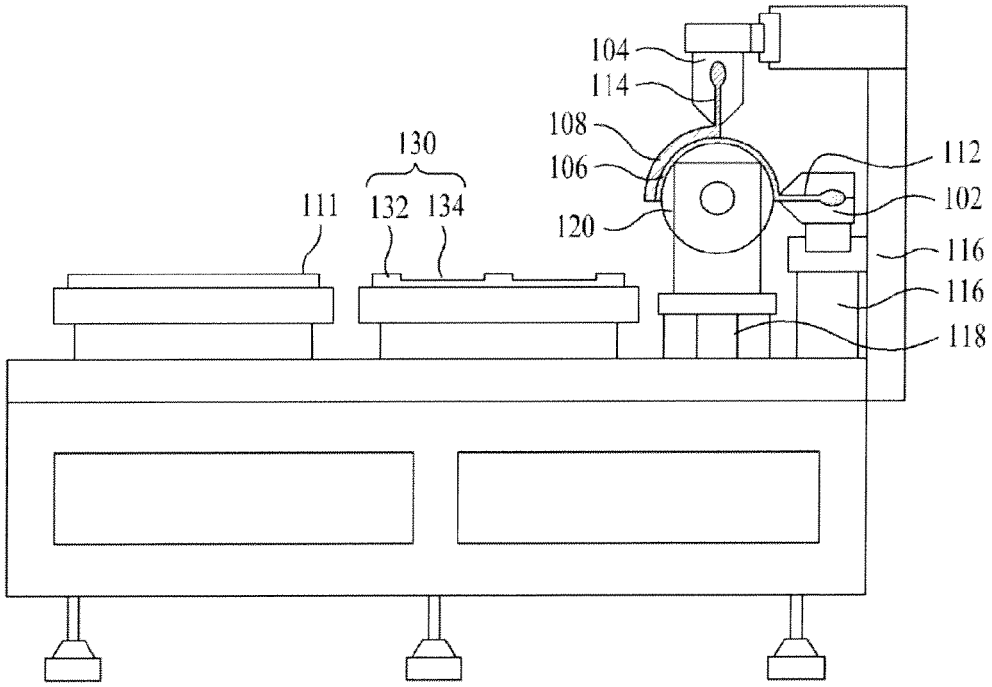
FIG. 4 illustrates a section of a printing apparatus in accordance with a second embodiment of the present invention.

FIG. 4 illustrates a section of a printing apparatus in accordance with a second embodiment of the present invention.

Detailed description of parts of the printing apparatus in FIG. 4 identical to the parts of the printing apparatus in FIG. 1 will be omitted.

Referring to FIG. 4, the printing apparatus includes first and second printing nozzles 102 and 104, blanket rollers 120, and a printing plate 130.

The first printing nozzle 102 is adjacent to the printing plate 130, and has a first outlet 112 formed parallel with a length direction of a substrate 111. The first printing nozzle 102 holds first printing ink 106 for supplying to the blanket roller 120 through the first outlet 112.

The second printing nozzle 104 is adjacent to the first printing nozzle 102. A second outlet 114 of the second printing nozzle 104 is formed parallel to a thickness direction of the substrate 111 such that the second outlet 114 is perpendicular or parallel to the first outlet 112 of the first printing nozzle 102.

The second printing nozzle 104 holds second printing ink 108 for supplying to the blanket roller 120 through the second outlet 114.

The blanket roller 120 rolls on the printing plate 130 and the substrate 111 in succession, making contact therewith.

The printing plate 130 is brought into contact with the blanket roller 120 such that the first and second printing ink 106 and 108 coated on the blanket roller 120 is applied to desired areas only. According to this, the first and second printing ink 106 and 108 on the blanket roller 120 matched to the depressed pattern 134 is remained on the blanket roller 120 to form the conductive metal pattern.

Figure 5:
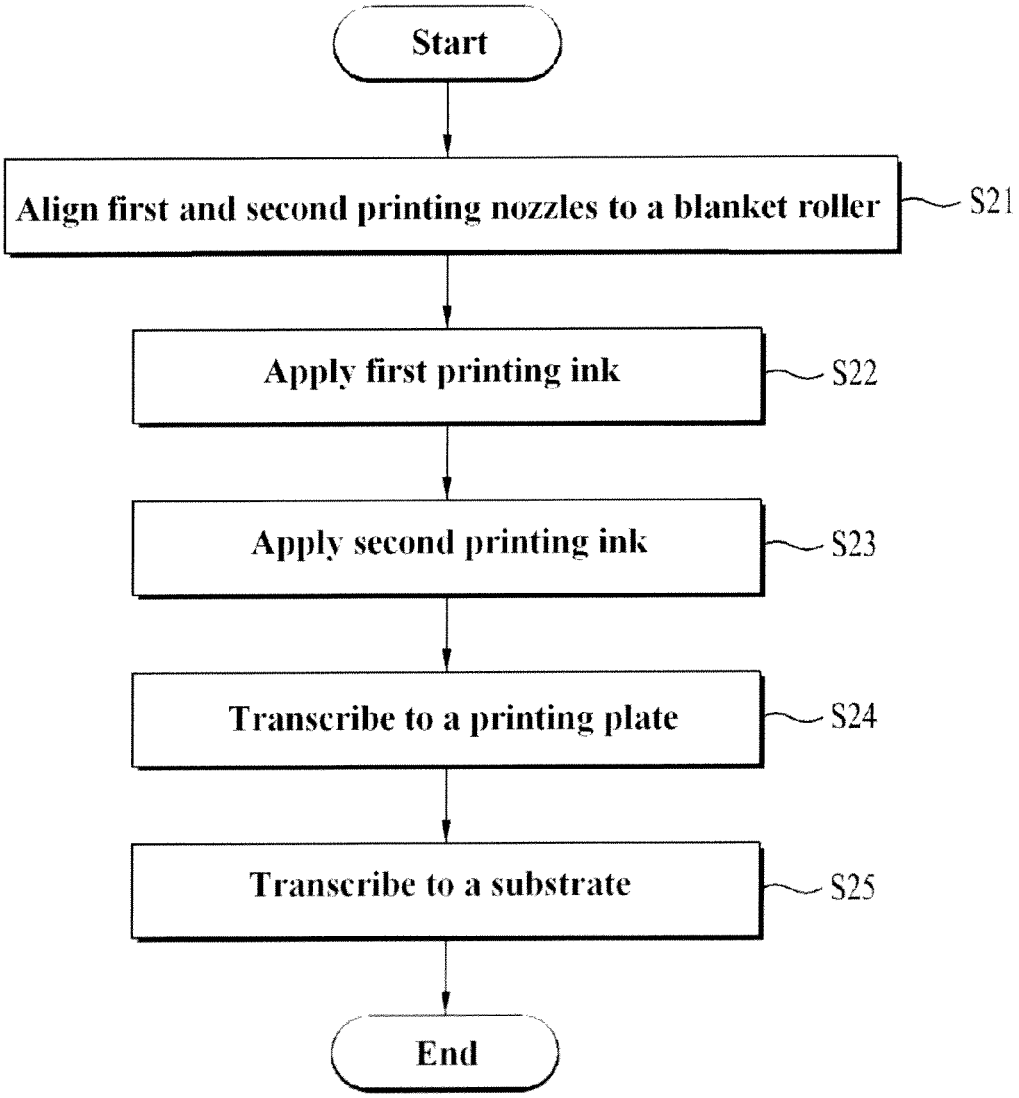
FIG. 5 illustrates a flow chart showing the steps of a method for forming a thin film pattern with a printing apparatus in accordance with a second embodiment of the present invention.

FIG. 5 illustrates a flow chart showing the steps of a method for forming a thin film pattern with a printing apparatus in FIG. 4, and FIGS. 6A~6E illustrate sections showing the steps of a method for forming a thin film pattern in FIG. 5.

Figure 6A:
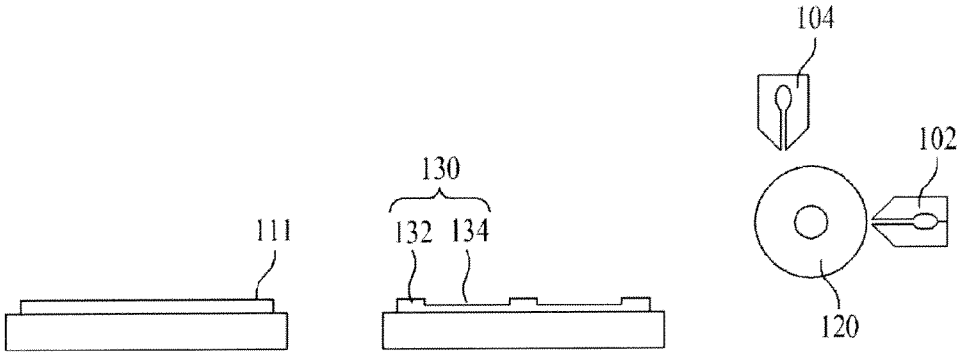
FIGS. 6A to 6E illustrate sections showing the steps of a method for forming a thin film pattern with a printing apparatus in accordance with a second embodiment of the present invention.

Referring to FIGS. 5 and 6A, as at least one of the first and second printing nozzles 102 and 104 and the blanket roller 120 moves through at least one of the roller aligning units 118 and the nozzle aligning units 116, positions of the blanket roller 120 and the first and second printing nozzles 102 and 104 are aligned (S21). In this instance, the blanket roller 120 is positioned adjacent to the first printing nozzle 102.

Figure 6B:
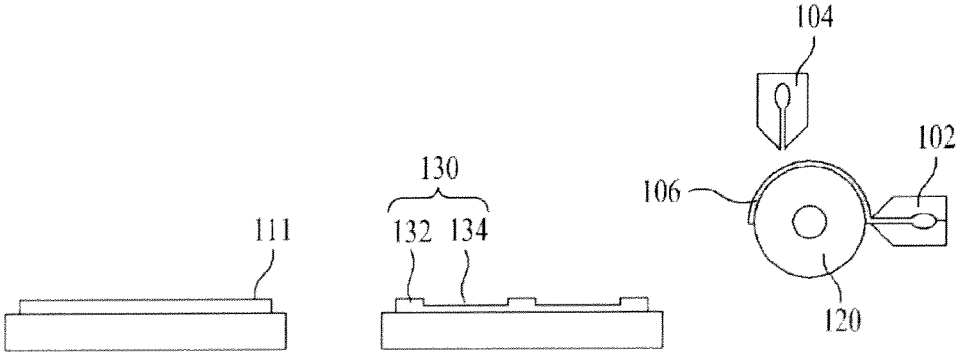

Referring to FIG. 6B, the first printing ink 106 is applied to the blanket roller 120 aligned with the first printing nozzle 102 thus, which is discharged through the first printing nozzle 102 (S22).

Figure 6C:
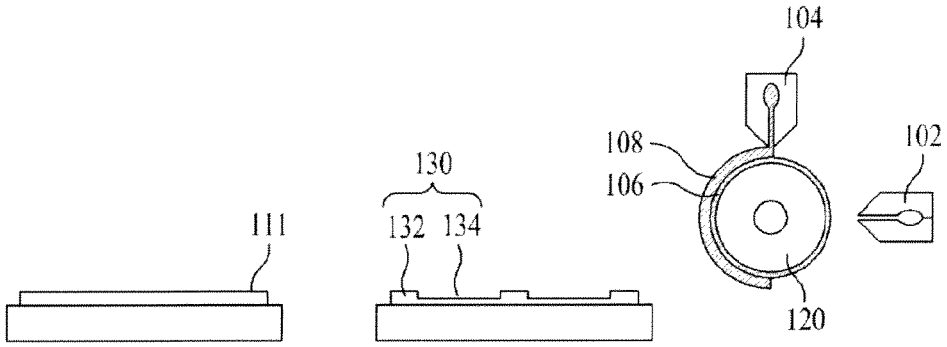

Referring to FIG. 6C, the second printing ink 108 is applied to the first printing ink 106 on the blanket roller 120 having the first printing ink 106 applied thereto thus through the second printing nozzle 104 (S23).

Figure 6D:
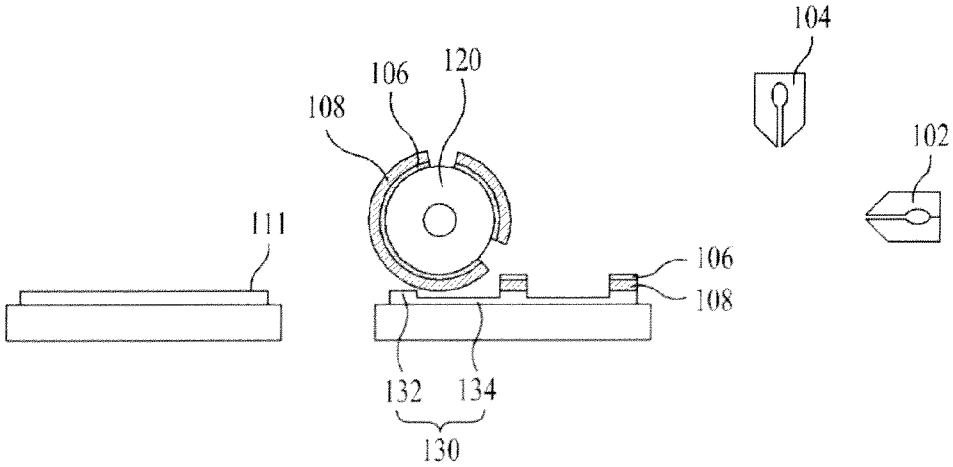

Referring to FIG. 6D, the blanket roller 120 having the first and second printing ink 106 and 108 applied thereto in succession thus rolls on the printing plate 130 having the depressed pattern 134 and the relieved pattern 132 (S24). The first and second printing ink 106 and 108 in areas which are brought into contact with the relieved pattern 132 has the first and second printing ink 106 and 108 transcribed thereto, and the first and second printing ink 106 and 108 in areas which are not brought into contact with the depressed pattern 134 is remained on a surface of the blanket roller 120.

Figure 6E:
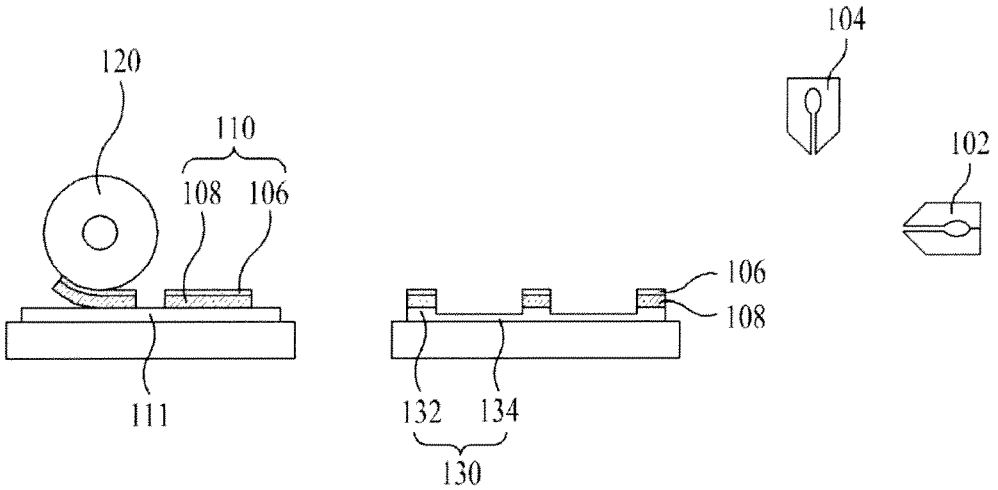

Referring to FIG. 6E, the blanket roller 120 having the first and second printing ink 106 and 108 remained thereon rolls on the substrate 111 (S25). According to this, the first and second printing ink 106 and 108 is transcribed, dried and cured on the substrate 111, to form the conductive metal pattern 110.

Thus, since the printing apparatus of the present invention can form at least two layers of printing ink on the blanket roller 120, enabling to form multi-layered thin films on the substrate 111 by one time of printing, a fabrication process can be made simple and a cost can be saved. Moreover, the application of the second printing ink 108 on the first printing ink 106 having the solvent of the low boiling point vaporized therefrom so as to be in a semi-dried state enhances adhesive force between the first and second printing ink 106 and 108. Furthermore, since the printing apparatus of the present invention forms the metal thin film pattern without a photolithography step, a cost can be saved.

Figure 7:
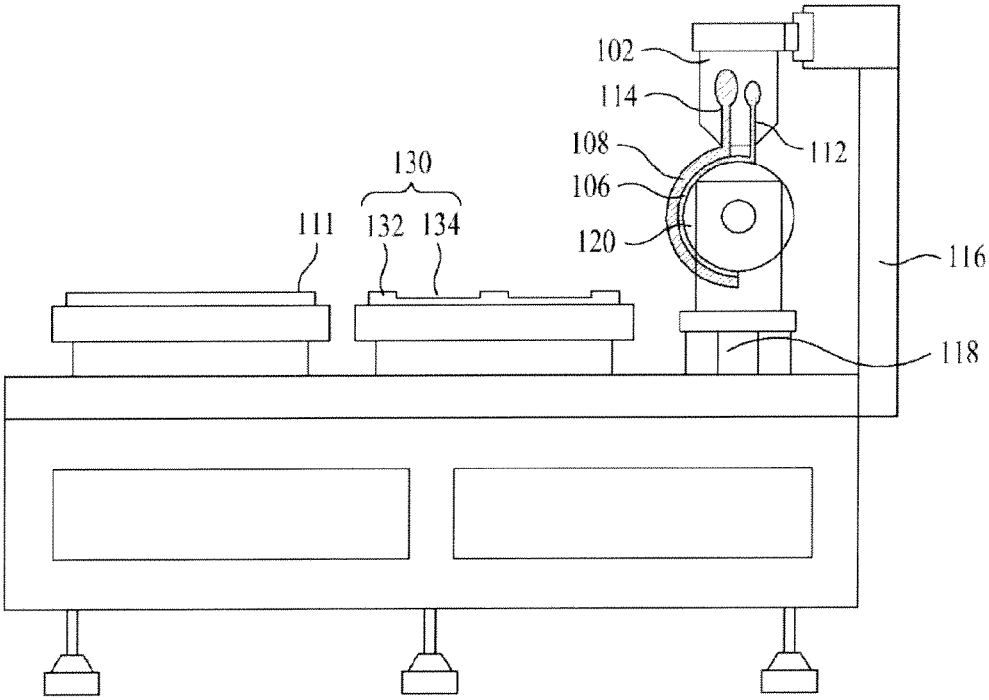
FIG. 7 illustrates a section of a printing apparatus in accordance with a third embodiment of the present invention.

FIG. 7 illustrates a section of a printing apparatus in accordance with a third embodiment of the present invention.

Detailed description of parts of the printing apparatus in FIG. 4 identical to the parts of the printing apparatus in FIG. 1 will be omitted.

Referring to FIG. 7, the printing apparatus includes printing nozzles 102, a blanket roller 120, a printing plate 130, a nozzle aligning unit 116, and a nozzle aligning unit 116.

Figure 8:
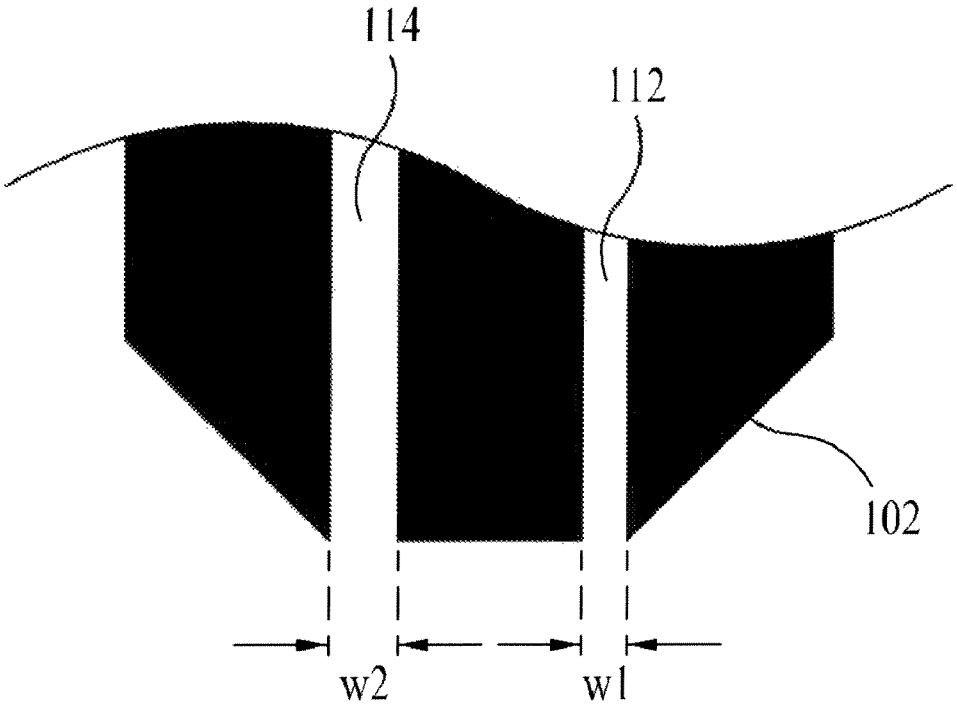
FIG. 8 illustrates a partial enlarged sectional view of the printing nozzle in FIG. 7.

The first printing nozzle 102 holds first and second printing ink 106 and 108 for supplying to the blanket roller 120 through the first and second outlets 112 114 as shown in FIG. 8. The first and second outlets 112 and 114 of the printing nozzle 102 are formed parallel to a length direction or a width direction of the substrate 111.

Since the second outlet 114 has a line width W2 greater than a line with W1 of the first outlet 112, the second printing ink 108 forms a layer thicker than a layer formed on the blanket roller 120 by the first printing ink 106.

The blanket roller 120 rolls on the printing plate 130 and the substrate 111 in succession, making contact therewith.

The printing plate 130 is brought into contact with the blanket roller 120 such that the first and second printing ink 106 and 108 coated on the blanket roller 120 is applied to desired areas only. According to this, the first and second printing ink 106 and 108 on the blanket roller 120 matched to the depressed pattern 134 is remained on the blanket roller 120 to form the conductive metal pattern.

Figure 9:
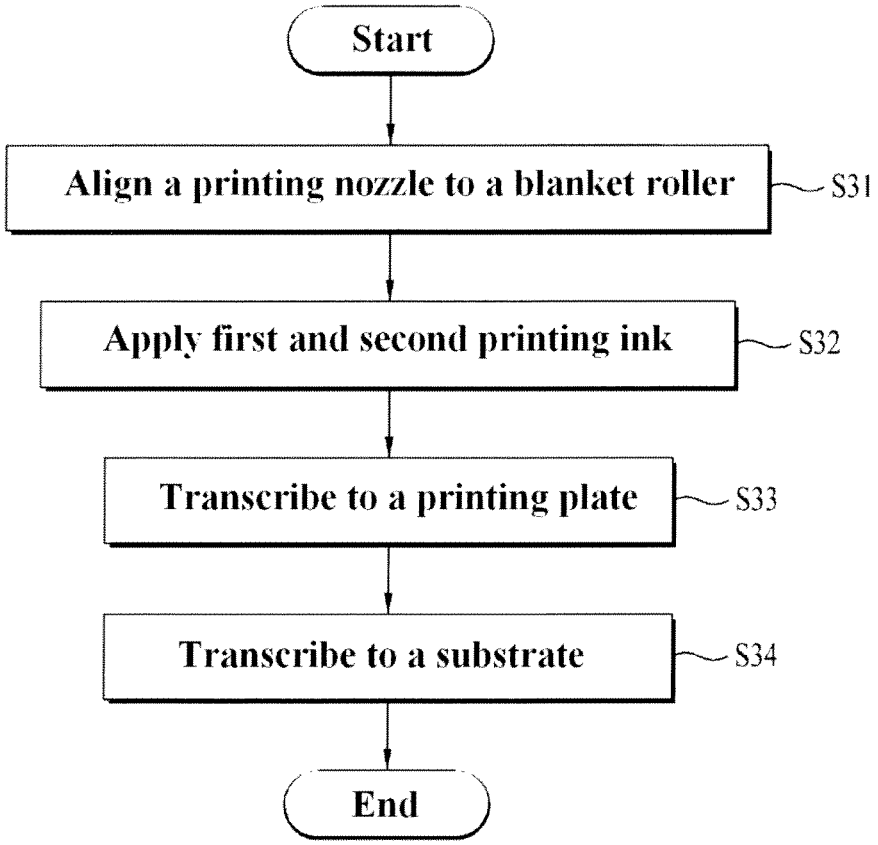
FIG. 9 illustrates a flow chart showing the steps of a method for forming a thin film pattern with a printing apparatus in accordance with a third embodiment of the present invention.

FIG. 9 illustrates a flow chart showing the steps of a method for forming a thin film pattern with a printing apparatus in FIG. 7, and FIGS. 10A~10D illustrate sections showing the steps of a method for forming a thin film pattern in FIG. 9.

Figure 10A:
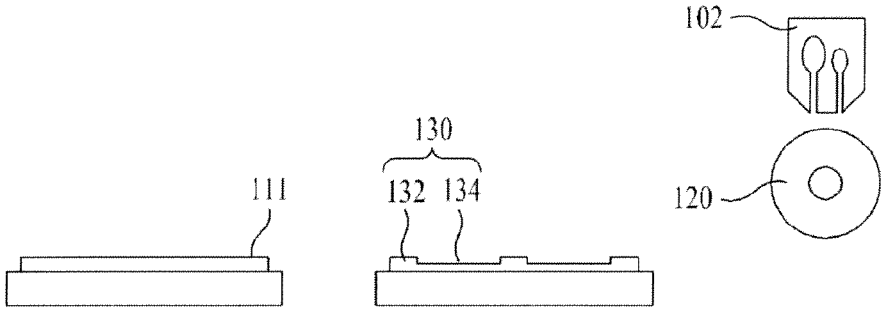
FIGS. 10A to 10D illustrate sections showing the steps of a method for forming a thin film pattern with a printing apparatus in accordance with a third embodiment of the present invention.

Referring to FIGS. 9 and 10A, as the printing nozzles 102 and the blanket roller 120 move through the roller aligning unit 118 and the nozzle aligning unit 116, positions of the blanket roller 120 and the printing nozzles 102 are aligned (S31).

Figure 10B:
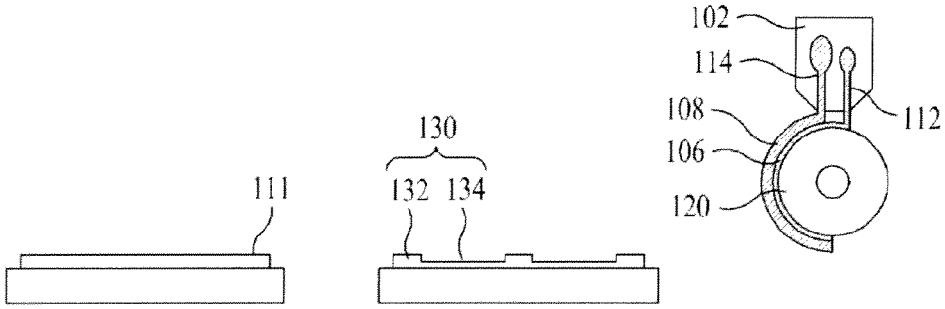

Referring to FIG. 10B, the first printing ink 106 being discharged through the first outlet 112 and the second printing ink 108 being discharged through the second outlet 114 is applied to the blanket roller 120 aligned with the printing nozzle 102 thus (S32).

Figure 10C:
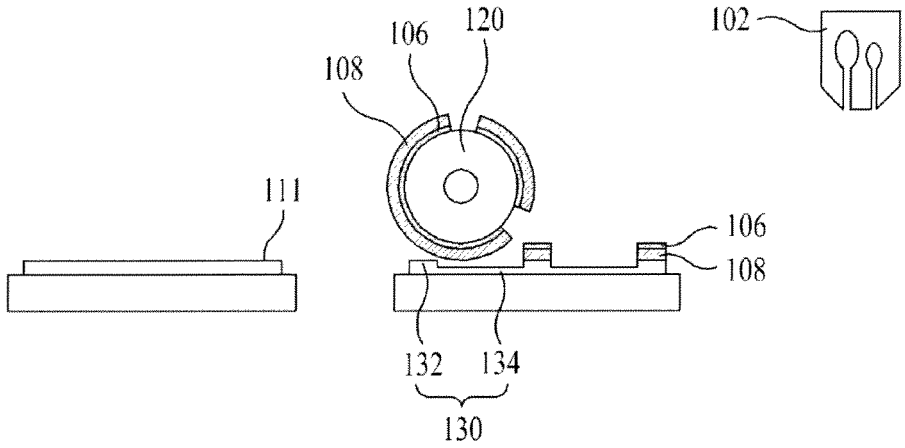

Referring to FIG. 10C, the blanket roller 120 having the first and second printing ink 106 and 108 applied thereto rolls on the printing plate 130 having the depressed pattern 134 and the relieved pattern 132 (S33). The first and second printing ink 106 and 108 in areas which are brought into contact with the relieved pattern 132 has the first and second printing ink 106 and 108 transcribed thereto, and the first and second printing ink 106 and 108 in areas which are not brought into contact with the depressed pattern 134 is remained on a surface of the blanket roller 120.

Figure 10D:
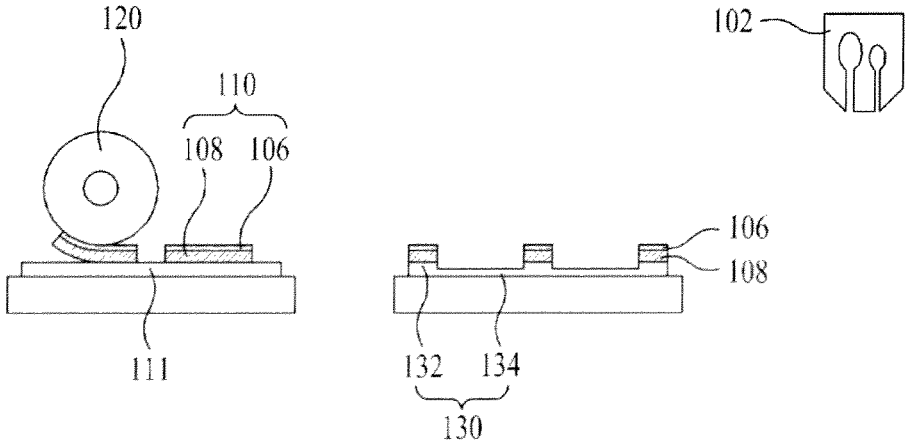

Referring to FIG. 10D, the blanket roller 120 having the first and second printing ink 106 and 108 remained thereon rolls on the substrate 111 (S34). According to this, the first and second printing ink 106 and 108 is transcribed, dried and cured on the substrate 111, to form the conductive metal pattern 110.

Thus, since the printing apparatus of the present invention can form at least two layers of printing ink on the blanket roller 120, enabling to form multi-layered thin films on the substrate 111 by one time of printing, a fabrication process can be made simple and a cost can be saved. Moreover, the application of the second printing ink 108 on the first printing ink 106 having the solvent of the low boiling point vaporized therefrom so as to be in a semi-dried state enhances adhesive force between the first and second printing ink 106 and 108. Furthermore, since the printing apparatus of the present invention forms the metal thin film pattern without a photolithography step, a cost can be saved.

In the meantime, the printing apparatus of the present invention can form thin films or thick films, not only on the liquid crystal panel, but also on a flat display device, such as a plasma display panel, an electroluminescence EL display panel, a field emission display device.

Figure 11:
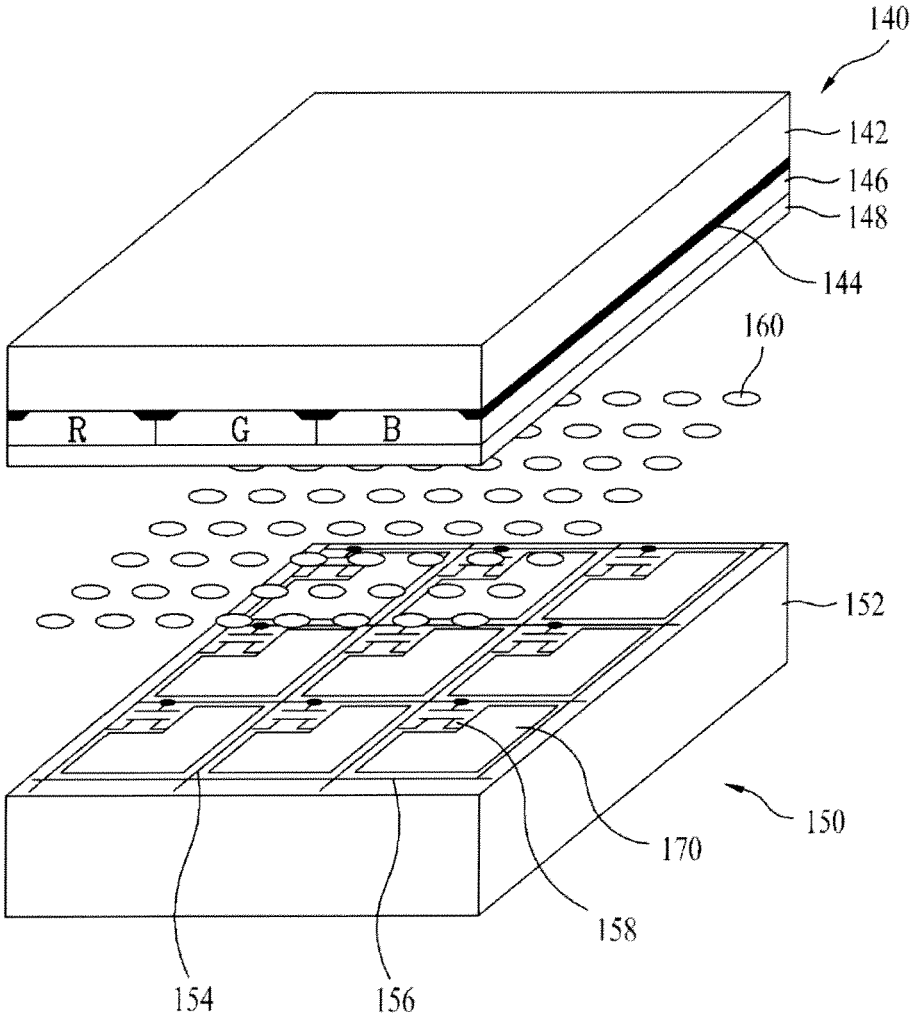
FIG. 11 illustrates a perspective view of a liquid crystal panel having a thin film pattern formed by a printing apparatus in accordance with one of first to third embodiments of the present invention.

In detail, referring to FIG. 11, the liquid crystal panel of the present invention includes a thin film transistor substrate 150 and a color filter substrate 140 bonded opposite to each other with a liquid crystal layer 160 disposed therebetween.

The color filter substrate 140 includes a black matrix 144, a color filter 146, a common electrode 148, column spacers (not shown) formed on an upper substrate 142 in succession.

The thin film transistor substrate 150 includes gate lines 156 and data lines 154 formed to cross each other, thin film transistor 158 formed adjacent to every crossing portion thereof, and a pixel electrode 170 formed at every pixel region formed by the crossed structure.

The printing apparatus of the present invention can form the color filter 146 and the black matrix of the liquid crystal panel, and thin films of organic substance, such as an organic thin film including the electroluminescence of an organic electroluminescence display device.

Though the printing apparatus of the present invention described taking two layered conductive metal pattern of first metal nano-powder and second metal nano-powder, the printing apparatus of the present invention is applicable to multi-layered conductive metal pattern of three or more than three layers.

As has been described, the printing apparatus of the present invention has the following advantages.

Since the printing apparatus of the present invention can form at least two layers of printing ink on the blanket roller, enabling to form multi-layered thin films on the substrate by one time of printing, a fabrication process can be made simple and a cost can be saved. Moreover, the application of the second printing ink on the first printing ink having the solvent of the low boiling point vaporized therefrom so as to be in a semi-dried state enhances adhesive force between the first and second printing ink. Furthermore, since the printing apparatus of the present invention forms the metal thin film pattern without a photolithography step, a cost can be saved.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A printing apparatus comprising:

a blanket roller;

a first outlet for discharging first printing ink to the blanket roller;

a second outlet for discharging second printing ink on the first printing ink in a state viscosity of the first printing ink is higher than a time when the first printing ink is discharged to the blanket roller, thereby forming two layers of the printing ink on the blanket roller, wherein the first and second printing ink are applied in succession on the same area of the blanket roller;

a printing plate for simultaneously removing the first and second printing ink from the blanket roller partially to form a conductive thin film on the blanket roller; and a substrate for having the conductive thin film transcribed thereto from the blanket roller, wherein the first and second outlets are formed in the same printing nozzle or different printing nozzles.

2. The printing apparatus as claimed in claim 1, wherein the first outlet is formed in the first printing nozzle and the second outlet is formed in the second printing nozzle, and the substrate and the printing plate are positioned between the first and second printing nozzles.

3. The printing apparatus as claimed in claim 1, wherein the first outlet is formed in the first printing nozzle and the second outlet is formed in the second printing nozzle, and the first and second printing nozzles are formed adjacent to the printing plate, and the first and second outlets are formed perpendicular to each other.

4. The printing apparatus as claimed in claim 1, wherein the first and second outlets are formed in the same nozzle, and the first and second outlet have line widths different from each other.

5. The printing apparatus as claimed in claim 1, wherein the first printing ink consists of metal nano-powder including silver, and a solvent of a low boiling point, and a solvent of a high boiling point, and the solvent of a low boiling point vaporizes before the second printing ink is coated such that viscosity of the first printing ink becomes higher than an initial state when the first printing ink is discharged from the first outlet.

6. The printing apparatus as claimed in claim 1, wherein the second printing ink includes $SnO_2$ which is a substance having adhesive force to the substrate better than the first printing ink.

7. A printing apparatus comprising:

a blanket roller;

a first outlet for discharging first printing ink to the blanket roller, the first printing ink consists of metal nano-powder, a solvent of a low boiling point and a solvent of a high boiling point;

a second outlet for discharging second printing ink on the first printing ink in a state viscosity of the first printing ink is higher than a time when the first printing ink is discharged to the blanket roller, thereby forming two layers of the printing ink on the blanket roller, wherein the first and second printing ink are applied in succession on the same area of the blanket roller;

a printing plate for simultaneously removing the first and second printing ink from the blanket roller partially to form a conductive thin film on the blanket roller; and a substrate for having the conductive thin film transcribed thereto from the blanket roller, wherein the first and second outlets are formed in the same printing nozzle or different printing nozzles.

8. The printing apparatus as claimed in claim 7, wherein the solvent of a low boiling point vaporizes before the second printing ink is coated such that viscosity of the first printing ink becomes higher than an initial state when the first printing ink is discharged from the first outlet.

9. The printing apparatus as claimed in claim 7, wherein the second printing ink includes $SnO_2$ which is a substance having adhesive force to a substrate better than the first printing ink.

10. A method for forming a thin film pattern comprising:

providing a printing apparatus having a blanket roller, a first outlet and a second outlet;

discharging first printing ink to the blanket roller using the first outlet;

discharging second printing ink on the first printing ink using the second outlet in a state viscosity of the first printing ink is higher than a time when the first printing ink is discharged to the blanket roller, thereby forming two layers of the printing ink on the blanket roller, wherein the first and second printing ink are applied in succession on the same area of the blanket roller, forming a conductive thin film on the blanket roller by simultaneously removing the first and second printing ink from the blanket roller partially using on a printing plate; and transcribing the conductive thin film by rolling the blanket roller on a substrate, wherein the first and second outlets are formed in the same printing nozzle or different printing nozzles.

11. The method as claimed in claim 10, wherein the first outlet is formed in the first printing nozzle and the second outlet is formed in the second printing nozzle, and the substrate and the printing plate are positioned between the first and second printing nozzles.

12. The method as claimed in claim 10, wherein the first outlet is formed in the first printing nozzle and the second outlet is formed in the second printing nozzle, and the first and second printing nozzles are formed adjacent to the printing plate, and the first and second outlets are formed perpendicular to each other.

13. The method as claimed in claim 10, wherein the first and second outlets are formed in the same nozzle, and the first and second outlet have line widths different from each other.

14. The method as claimed in claim 10, wherein the first printing ink consists of metal nano-powder including silver, and a solvent of a low boiling point, and a solvent of a high boiling point, and the solvent of a low boiling point vaporizes before the second printing ink is coated such that viscosity of the first printing ink becomes higher than an initial state when the first printing ink is discharged from the first outlet.

15. The method as claimed in claim 10, wherein the second printing ink includes $SnO_2$ which is a substance having adhesive force to the substrate better than the first printing ink.

* * * * *